US009051684B2

(12) United States Patent
Hua et al.

(10) Patent No.: US 9,051,684 B2
(45) Date of Patent: Jun. 9, 2015

(54) HIGH ASPECT RATIO CELLULOSE NANOFILAMENTS AND METHOD FOR THEIR PRODUCTION

(75) Inventors: Xujun Hua, Kirkland (CA); Makhlouf Laleg, Pointe-Claire (CA); Keith Miles, Montreal (CA); Reza Amiri, Kirkland (CA); Lahoucine Ettaleb, Pointe-Claire (CA); Gilles Dorris, Vimont Laval (CA)

(73) Assignee: FPINNOVATIONS, Pointe-Claire (CA)

( * ) Notice: Subject to any disclaimer, the term of this patent is extended or adjusted under 35 U.S.C. 154(b) by 470 days.

(21) Appl. No.: 13/353,358

(22) Filed: Jan. 19, 2012

(65) Prior Publication Data

US 2013/0017394 A1 Jan. 17, 2013

Related U.S. Application Data

(60) Provisional application No. 61/435,019, filed on Jan. 21, 2011.

(51) Int. Cl.
*D21H 11/16* (2006.01)
*D21H 11/18* (2006.01)
(Continued)

(52) U.S. Cl.
CPC ..... *D21D 1/30* (2013.01); *Y10T 428/298* (2015.01); *D21H 11/18* (2013.01); *D21D 1/20* (2013.01); *D21H 11/16* (2013.01)

(58) Field of Classification Search
CPC ..... D21C 9/007; D21H 11/18; D21H 11/16; D21D 1/20
USPC ..... 162/28, 56
See application file for complete search history.

(56) References Cited

U.S. PATENT DOCUMENTS 4,374,702 A 2/1983 Turbak et al.
5,964,983 A 10/1999 Dinand et al.
(Continued)

FOREIGN PATENT DOCUMENTS

CA 2327482 8/2000
WO 2004009902 1/2004
(Continued)

OTHER PUBLICATIONS

Wegner et al., Chapter 1: A fundamental Review of the Relationship between Nanotechnology and Lignocellulosic Biomass, 2009, WILEY, The Nanoscience and Technology of Renewable Biomaterials, p. 1-41.*
(Continued)

*Primary Examiner* — Anthony Calandra
(74) *Attorney, Agent, or Firm* — Norton Rose Fulbright Canada LLP

(57) ABSTRACT

A method to produce on a commercial scale, high aspect ratio cellulose nanofilaments (CNF) from natural lignocellulosic fibers comprises a multi-pass high consistency refining (HCR) of chemical or mechanical fibers using combinations of refining intensity and specific energy. The CNF produced represents a mixture of fine filaments with widths in the submicron and lengths from tens of micrometers to few millimeters. The product has a population of free filaments and filaments bound to the fiber core from which they were produced. The proportion of free and bound filaments is governed in large part by total specific energy applied to the pulp in the refiner, and differs from other cellulose fibrillar materials by their higher aspect ratio and the preserved degree of polymerization (DP) of cellulose, and are excellent additives for the reinforcement of paper, tissue, paperboard and the like. They display exceptional strengthening power for never-dried paper webs.

20 Claims, 6 Drawing Sheets

(51) Int. Cl.
*D21D 1/30* (2006.01)
*D21D 1/20* (2006.01)

(56) References Cited

U.S. PATENT DOCUMENTS

| | | | |
|---|---|---|---|
| 6,183,596 | B1 | 2/2001 | Matsuda et al. |
| 6,214,163 | B1 | 4/2001 | Matsuda et al. |
| 6,231,657 | B1 | 5/2001 | Cantiani et al. |
| 6,336,602 | B1 | 1/2002 | Miles |
| 6,455,661 | B1 | 9/2002 | Antal et al. |
| 6,602,994 | B1 | 8/2003 | Cash et al. |
| 6,818,101 | B2 | 11/2004 | Vinson et al. |
| 6,835,311 | B2 | 12/2004 | Koslow |
| 6,913,154 | B2 | 7/2005 | Koslow |
| 7,195,694 | B2 | 3/2007 | Von Drach et al. |
| 7,240,863 | B2 | 7/2007 | Ettaleb et al. |
| 7,297,228 | B2 | 11/2007 | Anderson et al. |
| 7,300,541 | B2 | 11/2007 | Sabourin |
| 7,381,294 | B2 | 6/2008 | Suzuki et al. |
| 7,431,799 | B2 | 10/2008 | Antal et al. |
| 7,566,014 | B2 | 7/2009 | Koslow et al. |
| 7,758,720 | B2 | 7/2010 | Sabourin |
| 7,758,721 | B2 | 7/2010 | Sabourin |
| 2008/0057307 | A1 | 3/2008 | Koslow et al. |
| 2009/0065164 | A1 | 3/2009 | Goto et al. |
| 2009/0151880 | A1 | 6/2009 | Aichinger et al. |
| 2009/0288789 | A1 | 11/2009 | Sabourin et al. |
| 2011/0277947 | A1 | 11/2011 | Hua et al. |
| 2013/0081769 | A1 * | 4/2013 | Kirov et al. ..... 162/60 |

FOREIGN PATENT DOCUMENTS

| | | |
|---|---|---|
| WO | 2005035866 | 4/2005 |
| WO | 2007091942 | 8/2007 |
| WO | 2010092239 | 8/2010 |
| WO | WO 2010131016 A2 * | 11/2010 |
| WO | 2011064441 | 6/2011 |

OTHER PUBLICATIONS

International Search Report, PCT/CA2012/000060, dated Apr. 24, 2012.

A.P. Shchniewind in Concise Encyclopedia of Wood & Wood-Based Materials, Pergamon, Oxford, p. 63 (1989).

* cited by examiner a b

HIGH ASPECT RATIO CELLULOSE NANOFILAMENTS AND METHOD FOR THEIR PRODUCTION

CROSS REFERENCE TO RELATED APPLICATION

This application claims the benefit under 35 U.S.C. 119(e) of U.S. Provisional Application Ser. No. 61/435,019, filed Jan. 21, 2011.

FIELD OF THE INVENTION

This invention relates to a novel method to produce on a commercial scale, high aspect ratio cellulose nanofilaments from natural fibers such as wood or agricultural fibers using high consistency refining (HCR).

PRIOR ART

Bleached and unbleached chemical pulp fibers processed from hardwood and softwood have traditionally been used for manufacturing paper, paperboard, tissue and pulp molded products. To reduce the production cost of publication paper grades such as newsprint, supercalendered or light weight coated paper, chemical pulp has progressively been displaced over the last decades by mechanical pulps produced from wood or recovered paper. With the decline of publication paper grades, in North America in particular, the amount of mechanical pulp produced and used in paper has decreased substantially while the proportion of chemical pulp from softwood in many paper grades continues to drop as well because modern paper machines have been designed to process weaker pulps and require less chemical softwood pulp which is the most expensive component of a furnish. However, mechanical and chemical pulp fibers have unique properties that find more and more usages in other areas than papermaking. Environment and climate changes makes the use of natural wood fiber a significantly planet friendly choice over traditional fossil based and other non-renewable materials. Though the green movement is expected to increase consumer demand for fiber based materials and products, it remains that these products must at least match the performance of the existing non-renewable products at a competitive price. In recent years, some manufacturers have used wood and plant fibers to replace man-made fibers such as glass fibers as reinforcement material for plastic composites because they have desirable attributes such as low density and abrasiveness, high specific strength and stiffness, and a high aspect ratio (length/diameter).

A single fiber is made up of linear long polymer chains of cellulose embedded in a matrix of lignin and hemicellulose. The cellulose content depends on the source of fiber as well as the pulping process used to extract fibers, varying from 40 to almost 100% for fibers made from wood and some plants like kenaf, hemp, and cotton. Cellulose molecule which forms the backbone of micro and nanofibrils is a polydisperse linear homopolymer of β (1, 4)-D glucose. The strength properties of natural fibers are strongly related to the degree of polymerization (DP) of cellulose—higher is better. For instance, the DP of native cellulose can be as high as 10,000 for cotton and 5,000 for wood. Depending on the severity of thermo-chemical cooking and thermo-mechanical pre-treatment during defiberizing process, the DP values of cellulose in papermaking fibers typically range between 1500 and 2000, while the DP for cotton linters is about 3000. The cellulose in dissolving pulps (used to make regenerated cellulose fiber) has an average DP of 600 to 1200. The caustic treatment in the subsequent dissolving process further reduces the DP to about 200. Nanocrystalline cellulose has a DP of 100-200 due to acidic hydrolysis in the process of librating the crystalline portion of the cellulose.

Though the intrinsic strength of fibers is important, as discussed above, basic fiber physics teach that a high aspect ratio is one of the key criteria for strengthening purposes because it promotes the connectivity or bonding degree of a percolating network, which in turn enhance its mechanical properties. Plant fibers such as hemp, flax, kenaf, jute and cotton are long and have aspect ratios typically ranging from 100 to 2000. On the other hand, wood fibers tend to be shorter than these plant fibers and have a smaller aspect ratio. For example, the dimensions of wood fibers commonly used to fabricate paper products are: 0.5 mm<length<5 mm and 8 μm<width<45 μm Thus, even the longest softwood fibers have a much lower aspect ratio compared to these plant fibers, but higher than hardwood fibers. It is well-known that short wood fibers, such as hardwood fibers produce inferior reenforcement power in a paper web than long wood fibers or plant fibers from, flax or hemp. Furthermore, the re-enforcing power of common wood fibers including softwood fibers is lower than plant fibers for the reinforcement of plastic composites.

The strengthening performance of wood and other plant fibers for papermaking products and plastic composites can be substantially improved when their aspect ratio (length/diameter) is increased while the degree of polymerization (DP) of their cellulose chain is minimally altered during treatment. Hence, fibers should ideally be processed such that their diameter is reduced as much as possible during treatment but with minimum breakage along the long fiber axis and concurrent prevention of cellulose chain degradation at the molecular level. Reduction in fiber diameter is possible because the morphology of cellulose fibers represents a well organized architecture of very thin fibrillar elements that is formed by long threads of cellulose chains stabilized laterally by hydrogen bonds between adjacent molecules. The elementary fibrils aggregate to produce micro and nanofibrils that compose most of the fiber cell wall (A. P. Shchniewind in Concise Encyclopedia of Wood & Wood-Based Materials, Pergamon, Oxford, p. 63 (1989)). Microfibrils are defined as thin fibers of cellulose of 0.1-1 μm in diameter, while nanofibrils possess one-dimension at the nanometer scale (<100 nm). Cellulose structure with high aspect ratio is obtained if the hydrogen bonds between these fibrils can be destroyed selectively to librates micro and nanofibrils without shortening them. It will be shown that the current methods of extracting cellulose suprastructures do not allow reaching these objectives.

Several methods have been described to produce valuable cellulose supramolecular structures from wood or agricultural fibers. The variety of acronyms for these structures as well as their description, method of production and applications were described and analyzed in our previous patent application (US 2011-0277947, published on Nov. 17, 2011). The various families of cellulosic materials differ from each other by the relative amount of free and bound fibrillar elements in the resultant products, their composition in terms of cellulose, lignin, and hemicellulose, the distribution of length, width, aspect ratio, surface charge, specific surface area, degree of polymerization and crystallinity. The structures span from the original fiber down to the smallest and strongest element of natural fibers, nanocrystalline cellulose (NCC). Owing to their market potential, various methods have been proposed to produce fibrillar cellulose elements of intermediate sizes between parent fibers and NCC (U.S. Pat. No. 4,374,702, U.S. Pat. No. 6,183,596 & U.S. Pat. No. 6,214,163, U.S. Pat. No. 7,381,294 & WO 2004/009902, U.S. Pat. No. 5,964,983, WO2007/091942, U.S. Pat. No. 7,191,694, US 2008/0057307, U.S. Pat. No. 7,566,014). Various names have been used to describe fibrillated fibers, namely microfibrillated cellulose, super-microfibrillated cellulose, cellulose microfibrils, cellulose nanofibrils, nanofibers, nanocellulose. They involve mostly mechanical treatments with or without the assistance of enzyme or chemicals. The chemicals used before mechanical treatment are claimed to help reducing energy consumption (WO2010/092239A1, WO2011/064441A1).

Mechanical methods to produce cellulose nanofibrils are generally performed using high shear homogenizers, low consistency refiners or a combination of both. There are two major problems with the existing methods: the relatively low aspect ratio after treatment limits the benefits associated with the use of such fibrillar structures in some matrices. Moreover, the production methods are not amenable to an easy and economical scale-up. Of particular pertinence for the current application is the work by Turbak (U.S. Pat. No. 4,374,702) for the production of microfibrillated cellulose using a homogenizer. Homogenizers require fiber pre-cutting to pass through the small orifice, which reduces fiber length and hence aspect ratio. Moreover, repeated passages of pre-cut fibers through one or a series of homogenizers inevitably promotes further fiber cutting, thus preventing high aspect ratio cellulose fibrils to be produced by this approach. Suzuki et al. (U.S. Pat. No. 7,381,294) avoided the use of homogenizers to produce microfibrillated cellulose but used instead, multi-pass low consistency refining of hardwood kraft pulp. The resulting microfibrillated cellulose consists of shortened fibers with a dense network of fibrils still attached to the fiber core. Again, like homogenizers, refiners operated at low consistency provoke severe fiber cutting, which prevents the formation of high aspect ratio fibrils. To reduce energy consumption, Lindstrom et al. (WO2007/091942), proposed an enzyme treatment prior to homogenizing but this treatment attacks the cellulose macromolecular chains, and further diminishes fibril length. The resulting fibril material, called nanocellulose, or nanofibrils, had a width of 2-30 nm, and a length of 100 nm to 1 μm, for an aspect ratio of less than 100. In general, our observations made at laboratory and pilot scales as well as literature results all indicate that treatment of pulp fibers with enzymes prior to any mechanical action accentuates fiber cutting and reduce the degree of polymerization of cellulose chains.

In summary, the above mentioned products, MFC, nanocellulose or nanofibrils, are relatively short particles of low aspect ratio and degree of polymerization (DP) compared to the original pulp fibers from which they were produced. They are normally much shorter than 100 μm and some may have a length even shorter than one 1 μm. Hence, in all methods proposed to date for producing microfibrils or nanofibrils, the pulp fibers have to be cut to be processable through the small orifice of a homogenizer, or shortened inevitably by mechanical, enzyme or chemical actions.

More recently, Koslow and Suthar (U.S. Pat. No. 7,566,014) disclosed a method to produce fibrillated fibers using open channel refining on low consistency pulps (i.e. 3.5% solids, by weight). They claim that open channel refining preserves fiber length, while close channel refining, such as a disk refiner, shortens the fibers. In their subsequent patent application (US 2008/0057307), the same inventors further disclosed a method to produce nanofibrils with a diameter of 50-500 nm. The method consists of two steps: first using open channel refining to generate fibrillated fibers without shortening, followed by closed channel refining to liberate the individual fibrils. Although the claimed length of the liberated fibrils is still the same as the starting fibers (0.1-6 mm), this is an unrealistic claim because closed channel refining inevitably shortens fibers and fibrils as indicated by the inventors themselves and by other disclosures (U.S. Pat. No. 6,231,657, U.S. Pat. No. 7,381,294). The inventors' close refining of Koslow et al refers to commercial beater, disk refiner, and homogenizers. These devices have been used to generate microfibrillated cellulose and nanocellulose in other prior art mentioned earlier. None of these methods generate the detached nano-fibril with such high length (over 100 micrometers). Koslow et al. acknowledge in US 2008/0057307 that a closed channel refining leads to both fibrillation and reduction of fiber length, and generate a significant amount of fines (short fibers). Thus, the aspect ratio of these nanofibrils should be similar to those in the prior art and hence relatively low. Furthermore, the method of Koslow et al. is that the fibrillated fibers entering the second stage have a freeness of 50-0 ml CSF, while the resulting nanofibers still have a freeness of zero after the closed channel refining or homogenizing. A zero freeness indicates that the nanofibrils are much larger than the screen size of the freeness tester, and cannot pass through the screen holes, thus quickly forms a fibrous mat on the screen which prevents water to pass through the screen (the quantity of water passed is proportional to the freeness value). Because the screen size of a freeness tester has a diameter of 510 micrometers, it is obvious that the nanofibers should have a width larger than 500 nm.

We discovered earlier (US 2011-0277947, published on Nov. 17, 2011) that long cellulose fibrils with high aspect ratio can be generated by a nanofilamentation device involving peeling off the fibrils from plant fibers with a set of sharp knifes rotating at very high speed. This approach generates high quality cellulose nanofilaments (CNF) of very high aspect ratios (up to 1000). Distinct from Koslow's nanofibrils, the CNF in an aqueous suspension exhibits a very high freeness value, typically greater than 700 ml CSF, because of the CNF's narrow width and shorter length relative to the parent fibers. However, a drawback of the rotating knife method is that the resulting CNF is too diluted (i.e. less than 2% on a weight basis) to be transported right after processing. Moreover, a very dilute suspension of CNF limits its incorporation in products like composites that require little or no water during their manufacturing. Hence, a drying step would be required with this approach, which hampers the economics of the method.

The new method of the present invention is based on high consistency refining of pulp fibers. High consistency here refers to a discharge consistency greater than 20%. High consistency refining is widely used for the production of mechanical pulps. The refiners for mechanical pulping consist of either a rotating-stationary disk combination (single disk) or two counter-rotating disks (double disk), operated under atmospheric conditions (i.e. open discharge) or under pressure (closed discharge). The surface of the disks is covered by plates with particular pattern of bars and grooves. The wood chips are fed into the center of the refiner. Refining not only separates fibers but also causes a variety of simultaneous changes to fiber structure such as internal and external fibrillation, fiber curl, fiber shortening and fines generation. External fibrillation is defined as disrupting and peeling-off the surface of the fiber leading to the generation of fibrils that are still attached to the surface of the fiber core. The fiber fibrillation increases their surface area, thus improves their bonding potential in papermaking.

Mechanical refiners can also be used to enhance the properties of chemical pulp fibers such as kraft fibers. The conventional refining of chemical pulp is carried out at a low consistency. The low consistency refining promotes fiber cutting in the early stages of the production. Moderate fiber cutting improves the uniformity of paper made therefrom, but is undesirable for the fabrication of high aspect ratio cellulose suprastructures. High consistency refining is used in some applications of kraft pulp, for example for the production of sack paper. In such applications of kraft pulp refining, the energy applied is limited to a few hundred kWh per tonne of pulp, because applying energy above this level would drastically reduce fiber length and make the fibers unsuitable for the applications. Kraft fibers have never been refined to an energy level over 1000 kWh/t in the past.

Miles disclosed that, in addition to high consistency, a low refining intensity further preserves fiber length and produces high quality mechanical pulps (U.S. Pat. No. 6,336,602). The reduced refining intensity is achieved by lowering disk rotating speed. Ettaleb et al. (U.S. Pat. No. 7,240,863) disclosed a method of improving pulp quality by increasing inlet pulp consistency in a conical refiner. The higher inlet consistency also reduces refining intensity, so helps reducing fiber cutting. The products from both methods are fiber materials for papermaking. There has never been any attempt to produce cellulose micro fibers, microfibrillated cellulose, cellulose fibrils, nanocellulose or cellulose nanofilaments using high consistency and/or low intensity refining.

SUMMARY OF THE INVENTION

It is an object of this invention to provide high aspect ratio cellulose nanofilaments (CNF).

It is another object of this invention to provide a method of producing high aspect ratio cellulose nanofilaments (CNF).

It is a further object of this invention to provide products based on or containing the high aspect ratio cellulose nanofilaments (CNF).

In one aspect of the invention there is provided a method for producing high aspect ratio cellulose nanofilaments (CNF), comprising: refining pulp fibers at a high total specific refining energy under conditions of high consistency. In a particular embodiment the refining is at a low refining intensity.

In another aspect of the invention there is provided a mass of high aspect ratio disc-refined cellulose nanofilaments (CNF), comprising cellulose nanofilaments (CNF) having an aspect ratio of at least 200 up to a few thousands and a width of 30 nm to 500 nm.

In still another aspect of the invention there is provided a film formed from the mass of high aspect ratio cellulose nanofilaments (CNF) of the invention.

In yet another aspect of the invention there is provided a substrate reinforced with the mass of high aspect ratio cellulose nanofilaments (CNF) of the invention.

In a further aspect of the invention there is provided a composition comprising a mass of high aspect ratio disc-refined cellulose nanofilaments (CNF), wherein said cellulose nanofilaments (CNF) comprise uncut filaments retaining the length of the filaments in the undisc-refined parent fibers.

In a still further aspect of the invention there is provided a reinforcing agent comprising the mass or the composition of the invention.

In a yet further aspect of the invention there is provided a film or coating formed from the mass or the composition of the invention.

In this Specification the term "disc-refined" CNF refers to CNF made by disc refining in a disc refiner; and the term "undisc-refined" refers to the parent fibers prior to the disc refining in a disc refiner to produce CNF.

The aspect ratio of the CNF in this invention will be up to 5,000, i.e. 200 to 5,000 and typically 400 to 1,000.

DETAILED DESCRIPTION OF THE INVENTION

A new method of producing high aspect ratio cellulose nanofilaments (CNF) has been developed. It consists of refining cellulose fibers at a very high level of specific energy using disk refiners operating at a high consistency. In a particular embodiment the refining is at a low refining intensity.

The key element of this invention is a unique combination of refining technologies, high consistency refining, and preferably low intensity refining to apply the required energy for the production of high aspect ratio CNF using commercially available chip refiners. A plurality, preferably several passes are needed to reach the required energy level. The high consistency refining may be atmospheric refining or pressurized refining.

Thus the present invention provides a new method to prepare a family of cellulose fibrils or filaments that present superior characteristics compared to all other cellulosic materials such as MFC, nanocellulose or nanofibrils disclosed in the above mentioned prior arts, in terms of aspect ratio and degree of polymerization. The cellulosic structures produced by this invention, named as cellulose nanofilaments (CNF), consist in a distribution of fibrillar elements of very high length (up to millimeters) compared to materials denoted microfibrillated cellulose, cellulose microfibrils, nanofibrils or nanocellulose. Their widths range from the nano size (30 to 100 nm) to the micro size (100 to 500 nm).

The present invention also provides a new method which can generate cellulose nanofilaments at a high consistency, at least 20% by weight, and typically 20% to 65%. The present invention further provides a new method of CNF production which can be easily scaled up to a mass production. In addition, the new method of CNF production according to the present invention could use the existing commercially available industrial equipment so that the capital cost can be reduced substantially when the method is commercialized.

The manufacturing process of CNF according to the present invention has much less negative effect on fibril length and cellulose DP than methods proposed to date. The novel method disclosed here differs from all other methods by the proper identification of unique set of process conditions and refining equipment in order to avoid fiber cutting despite the high energy imparted to wood pulps during the process. The method consists of refining pulp fibers at a very high level of specific energy using high consistency refiners and preferably operating at low refining intensity. The total energy required to produce CNF varies between 2,000 and 20,000 kWh/t, preferably 5,000 to 20,000 kWh/t and more preferably 5,000 to 12,000 kWh/t, depending on fiber source, percentage of CNF and the targeted slenderness of CNF in the final product. As the applied energy is raised, the percentage of CNF increases, the filaments become progressively thinner. Typically several passes are needed to reach the required energy level. Besides the target energy level, the number of passes also depends on refining conditions such as consistency, disk rotating speed, gap, and the size of refiner used etc, but it is usually greater than two but less than fifteen for atmospheric refining, and less than 50 for pressurized refining. The specific energy per pass is adjusted by controlling the plate gap opening. The maximum energy per pass is dictated by the type of refiner used in order to achieve stability of operation and to reach the required quality of CNF. For example, trials performed using a 36" double disc refiner running at 900 RPM and 30% consistency demonstrated that it was possible to apply energy in excess of 15,000 KWh/tonne in less than 10 passes.

Production of CNF on a commercial scale can be continuous on a set of refiners aligned in series to allow for multi-pass refining, or it can be carried out in batch mode using one or two refiners in series with the refined material being re-circulated many times to attain the target energy.

Low refining intensity is achieved through controlling two parameters: increasing refining consistency and reducing disc rotation speed. Changing refiner disc rotational speed (RPM) is by far the most effective and the most practical approach. The range of RPM to achieve low-intensity refining is described in previous (U.S. Pat. No. 6,336,602). In the present invention, use of double disc refiners requires that one or both discs be rotated at less than 1200 RPM, generally 600 to 1200 RPM and preferably at 900 RPM or less. For single disc refiners, the disc is rotated at less than the conventional 1800 RPM, generally 1200 to 1800 RPM, preferably at 1500 RPM or less.

High discharge consistency can be achieved in both atmospheric and pressurized refiners. The pressurized refining increases the temperature and pressure in the refining zone, and is useful for softening the lignin in the chips which facilitates fiber separation in the first stage when wood chips are used as raw material. When the raw material is chemical kraft fibers, a pressurized refiner is generally not needed because the fibers are already very flexible and separated. Inability to apply a sufficient amount of energy on kraft pulp is a major limitation for using a pressurized refiner. In our pilot plant, trials for making CNF with a pressurized refiner were conducted and the maximum specific energy per pass that was possible to apply on kraft fibers before running into instability of operation was around 200 kWh/T only. On the other hand, it was possible to reach 1500 kWh/T and higher with atmospheric low intensity refining. Consequently, using pressurized refining to produce CNF would lead to a higher number of passes than atmospheric refining to reach the target refining specific energy. However, pressurized refining allows recovering the steam energy generated during the process.

High consistency here refers to a discharge consistency that is higher than 20%. The consistency will depend on the type and size of the refiner employed. Small double disc refiners operate in the lower range of high consistency while in large modern refiners the discharge consistency can exceed 60%.

Cellulose fibers from wood and other plants represent raw material for CNF production according to the present invention. The method of the present invention allows CNF to be produced directly from all types of wood pulps without pretreatment: kraft, sulfite, mechanical pulps, chemi-thermo-mechanical pulps, whether these are bleached, semi-bleached or unbleached. Wood chips can also be used as starting raw material. This method can be applied to other plant fibers as well. Whatever is the source of natural fibers, the resultant product is made of a population of free filaments and filaments bound to the fiber core from which they were produced. The proportion of free and bound filaments is governed in large part by total specific energy applied to the pulp in the refiner. The both free and bound filaments have a higher aspect ratio than microfibrillated cellulose or nanocellulose disclosed in the prior art. The lengths of our CNF are typically over 10 micrometers, for example over 100 micrometers and up to millimeters, yet can have very narrow widths, about 30-500 nanometers. Furthermore, the method of the present invention does not reduce significantly the DP of the source cellulose. For example, the DP of a CNF sample produced according to this invention was almost identical to that of the starting softwood kraft fibers which was about 1700. As will be shown in the subsequent examples, the CNF produced according to this invention is extraordinarily efficient for reinforcement of paper, tissue, paperboard, packaging, plastic composite products, and coating films. Their reinforcing power is superior to many existing commercial water-soluble or aqueous emulsion of strengthening polymeric agents including starches, carboxymethyl cellulose and synthetic polymers or resins. In particular, the strength improvement induced by incorporation of the high-aspect ratio filaments in never-dried paper webs is remarkable.

The CNF materials produced according to this invention represent a population of cellulose filaments with a wide range of diameters and lengths as described earlier. The average of the length and width can be altered by proper control of applied specific energy. Method disclosed permits the passage of pulp more than 10 times at more than 1500 kWh/t per pass in high consistency refiner without experiencing severe fiber cutting that is associated with low consistency refiners, grinders or homogenizers. The CNF product can be shipped as is in a semi-dry form or used on site following simple dispersion without any further treatment.

The CNF product made according to this invention can be dried before being delivered to customers to save transportation cost. The dried product should be well re-dispersed with a make-up system before use. If desired, the CNF can also be treated or impregnated with chemicals, such as bases, acids, enzymes, solvents, plasticizers, viscosity modifiers, surfactants, or reagents to promote additional properties. The chemical treatment of CNF may also include chemical modifications of the surfaces to carry certain functional groups or change surface hydrophobicity. This chemical modification can be carried out either by chemical bonding, or adsorption of functional groups or molecules. The chemical bonding could be introduced by the existing methods known to those skilled in the art, or by proprietary methods such as those disclosed by Antal et al. (U.S. Pat. Nos. 6,455,661 and 7,431,799).

A decisive advantage of this invention is ultimately the possibility of achieving a much higher production rate of CNF than with the equipment and devices described in the prior art section to produce microfibrillated or nanofibrillar cellulose materials. Though the manufacture of CNF can be carried out in a new mill designed for this purpose, the present method offers a unique opportunity to revive a number of mechanical pulp lines in mills that have been idle due to the steep market decline of publication paper grades, like newsprint. Production on a commercial scale can be done using existing high consistency refiners in either atmospheric or pressurized mode.

While it is not the intention to be bound by any particular theory regarding the present invention, the mechanism of CNF generation using the present method might be summarized as follows:

Although low consistency refining is the conventional method of developing the properties of kraft pulp, this process limits the amount of energy which can be applied and adversely affects fiber length. At high consistency, the mass and therefore quantity of fiber in the refining zone is much greater. For a given motor load, the shear force is distributed over a much greater fiber surface area. The shear stress on individual fibers is therefore greatly reduced with much less risk of damage to the fiber. Thus, much more energy can be applied. Since the energy requirements for CNF production are extremely high and fiber length preservation is essential, high consistency refining is necessary.

As mentioned earlier, pressurized refining limits the amount of energy that can be applied in a single pass when compared to atmospheric refining. This is because pressurized refining leads to a much smaller plate gap, a consequence of thermal softening of the material at the higher temperature to which it is exposed in the pressurized process. In addition, kraft fiber in particular is already flexible and compressible which further reduces the plate gap. If the plate gap is too small, it becomes difficult to evacuate the steam, difficult to load the refiner, and the operation becomes unstable.

Finally, at a given energy, Miles (U.S. Pat. No. 6,336,602) teaches that when low intensity refining is achieved by reducing disk rotating speed, the residence time of the pulp in the refining zone increases, resulting in a greater fiber mass to bear the applied load. As a consequence, a higher motor load and therefore more energy can be applied without damaging the fiber. This is well illustrated by comparing the results obtained in our pilot plant facilities at low-intensity refining and conventional refining of kraft pulp. With increasing specific energy, the long fiber fraction decreases much faster with conventional refining than with low intensity refining (FIG. 1). This makes low intensity refining the preferred method for the production of CNF with high aspect ratio.

EXAMPLES

The following examples help to understand the present invention and to carry-out the method for producing the said cellulose nanofilaments and the application of the product as reinforcement additive for paper. These examples should be taken as illustrative and are not meant to limit the scope of the invention.

Example 1

Figure 1:
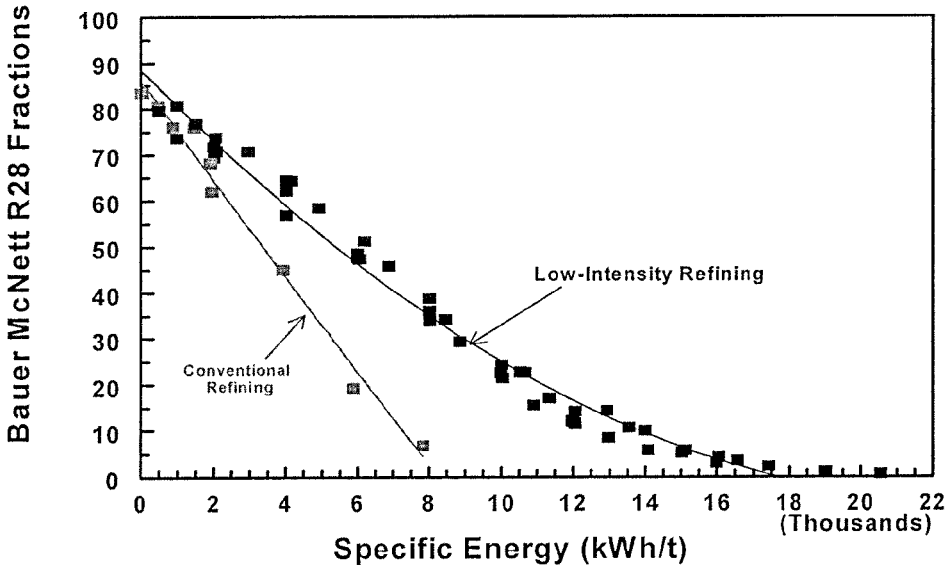
FIG. 1: Comparison of long fiber fraction (Bauer McNett R28) after conventional and low-intensity refining of a bleached kraft pulp.
Figure 2:
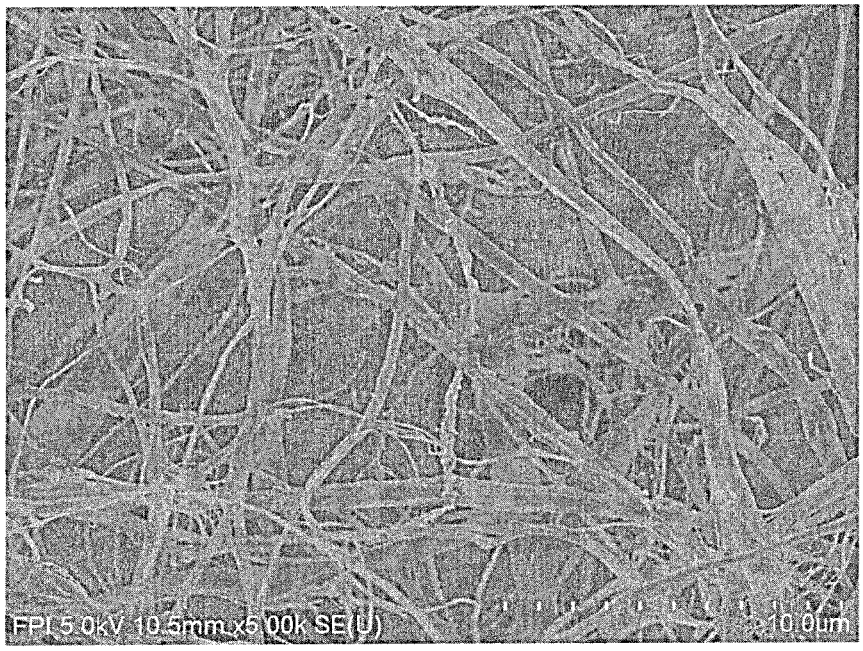
FIG. 2: SEM photomicrograph of cellulose nanofilaments produced in high consistency refiner using bleached softwood kraft pulp.
Figure 3:
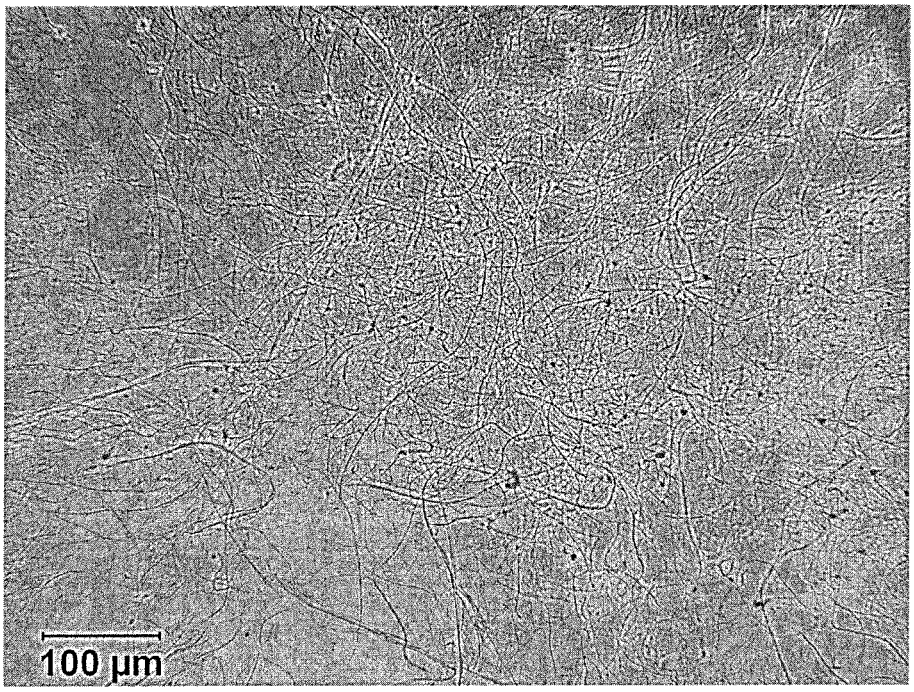
FIG. 3: Light microscope photomicrograph of cellulose nanofilaments produced in high consistency refiner using bleached softwood kraft pulp same as in FIG. 2.

CNF was produced from a bleached softwood kraft pulp using a 36" double disc refiner with a standard Bauer disc pattern 36104 and running at 900 RPM and 30% consistency. FIG. 2 shows Scanning Electron Microscopy (SEM) image of CNF made in this way after 8 passes. FIG. 3 is the corresponding micrograph using light microscopy. The high aspect ratio of the material is clearly visible.

Example 2

Figure 4A:
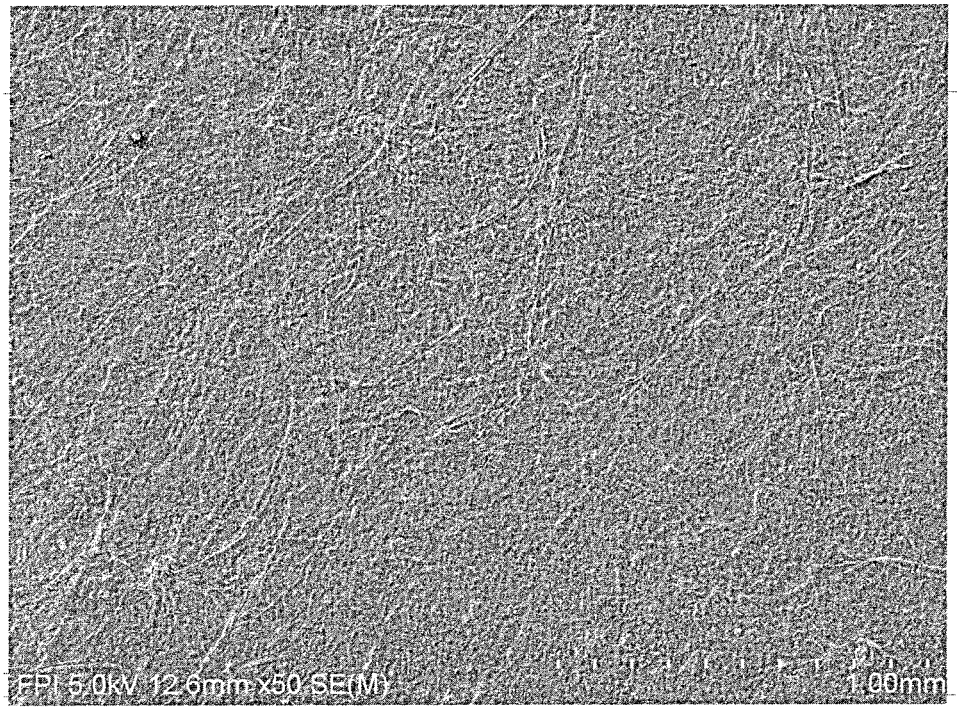
FIG. 4: (a) Low SEM micrograph of CNF film, (b) Higher magnification SEM micrograph of CNF film, and (c) Force-Elongation curve of CNF sheet.
Figure 4B:
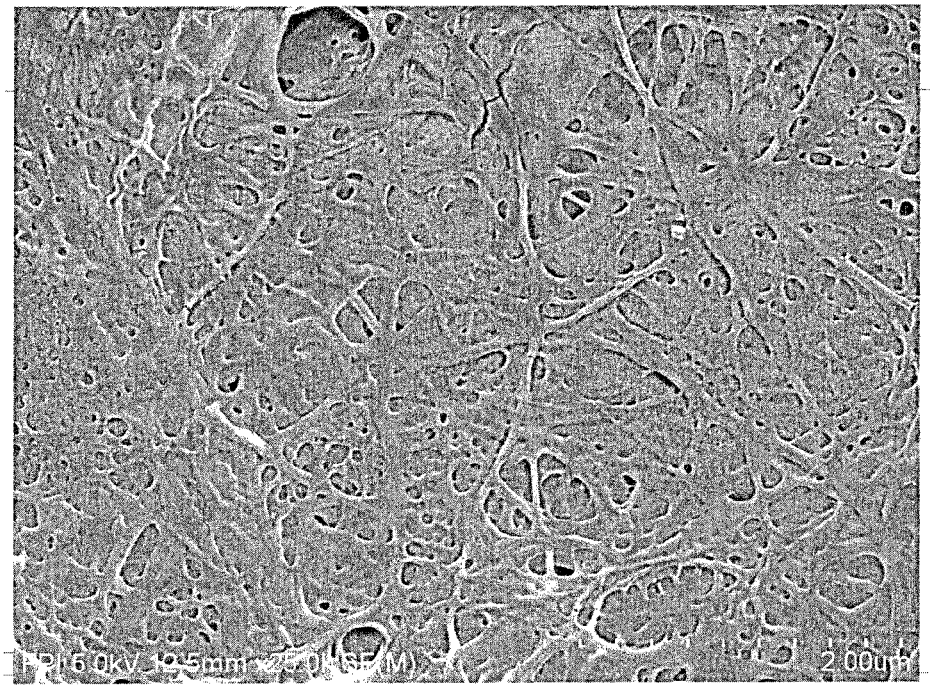

The CNF produced from bleached softwood kraft pulp of Example 1 was dispersed in water to 2% consistency in a laboratory standard British disintegrator (TAPPI T205 sp-02). The dispersed suspension was used to make cast films of 100 μm thickness. The air dried sheet was semi transparent and rigid with a specific density of 0.98 g/cm$^3$ and an air permeability of zero (as measured by a standard PPS porosity meter). FIG. 4*a* and FIG. 4*b* show SEM micrographs of the CNF film at two magnification levels. The CNF formed a film-like, well bonded microstructure of entangled filaments.

Figure 4C:
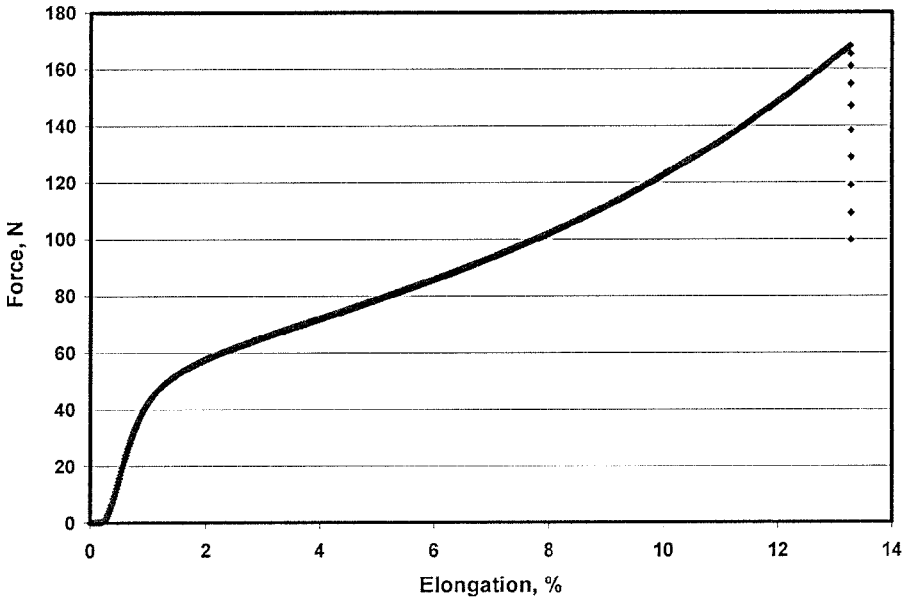

FIG. 4*c* presents the load-strain curve as measured on an Instron Testing Equipment at a crosshead speed of 10 cm/min using a strip with dimensions of 10 cm length×15 mm width×0.1 mm thickness. The tensile strength and stretch at the break point were 168 N and 14%, respectively.

Example 3

Figure 5A:
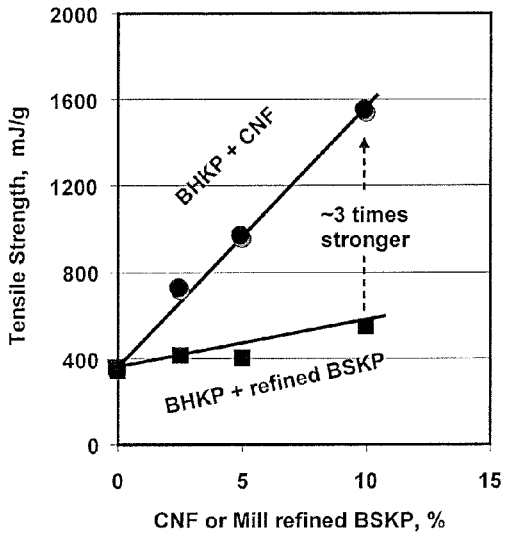
FIG. 5: Tensile strength (a) and PPS porosity (b) of sheets made from BHKP blended either with refined BSKP or with CNF.
Figure 5B:
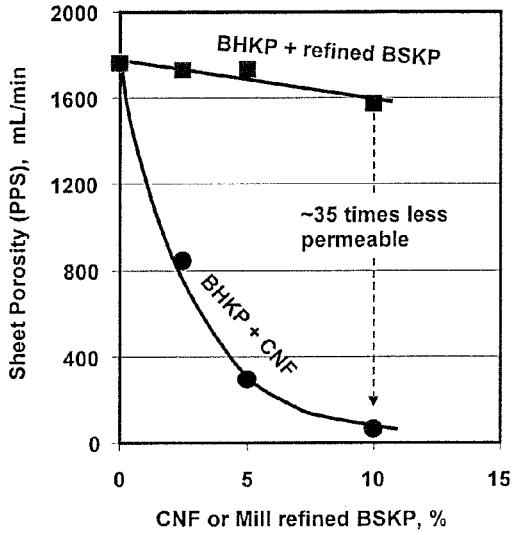

FIG. 5*a* and FIG. 5*b* compare the properties of 60 g/m$^2$ handsheets made from reslushed dry lap bleached hardwood kraft pulp (BHKP) blended with varying levels of a mill refined bleached softwood kraft pulp (BSKP) or CNF produced according to this invention using the same procedure described in Example 1. Refined BSKP with a Canadian standard freeness CSF of 400 mL was received from a mill producing copy and offset fine paper grades. All sheets were made with addition of 0.02% cationic polyacrylamide as retention aid. The results clearly show that on increasing the dosage of CNF the tensile strength (a) is dramatically increased and the PPS porosity (b) is drastically reduced. A low PPS porosity value corresponds to very low air permeability. On comparing CNF with mill refined BSKP, the CNF-reinforced sheet was 3 times stronger than that reinforced by BSKP.

Example 4

Figure 6:
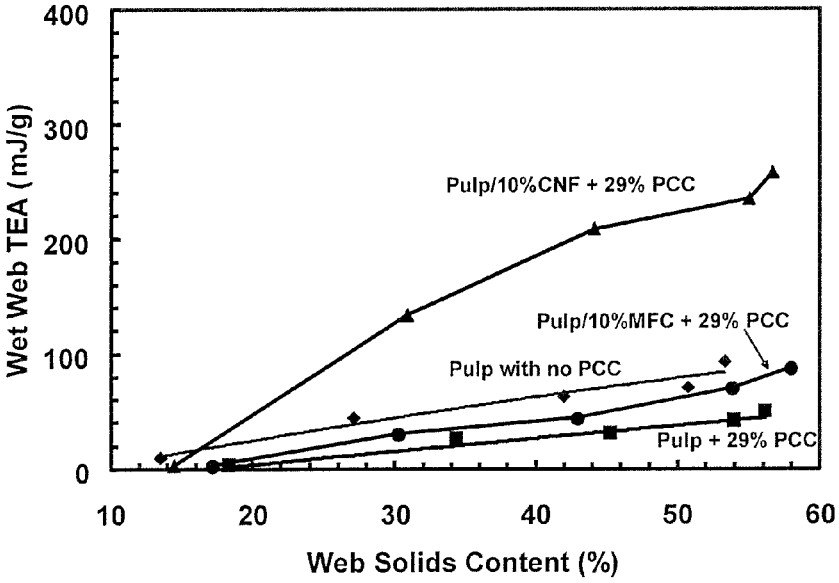
FIG. 6: Comparison of CNF with commercial MFC in term of strengthening of wet-web.

A CNF was produced according to this invention from a bleached softwood kraft pulp after 10 passes on HCR operated at 30% consistency. This product was first dispersed in water by using a laboratory standard British disintegrator (TAPPI T205 sp-02) and then added to a fine paper furnish, containing 25% bleached softwood and 75% bleached hardwood kraft pulps, to produce 60 g/m$^2$ handsheets containing 10% CNF of this invention and 29% precipitated calcium carbonate (PCC). Control handsheets were also made with PCC only. For all sheets an amount of 0.02% cationic polyacrylamide was used to assist retention. FIG. 6 shows the wet-web tensile strength as a function of web-solids. Clearly, on adding PCC alone to the pulp furnish a drastic reduction in wet-web strength was measured compared to the control sheet without PCC. The introduction of 10% commercial MFC slightly improved the wet-web strength of the filled sheet, whereas a 10% CNF addition substantially improved the wet-web strength of the PCC filled sheet and the strength was even much better than the unfilled control sheet. This illustrates that the CNF produced according to the present invention is a super strengthening agent for never-dried moist sheet.

The tensile strength of dry sheets containing CNF was also improved significantly. For example, the sheet containing 29% PCC had a tensile energy absorption index (TEA) of 222 mJ/g in the absence of CNF. When CNF was added into the furnish before sheet making at a dosage of 10%, the TEA was improved to 573 mJ/g, an increase of 150%.

Example 5

Figure 7:
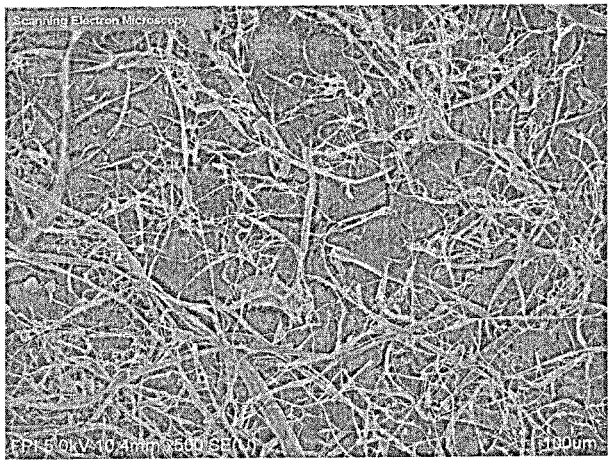
FIG. 7: Photomicrographs of cellulose nanofilaments produced in high consistency refiner using mechanical pulp.

Trials were also performed with black spruce wood chips as raw material. In those trials, the first stage refining was done with a 22" pressurized refiner running at 1800 RPM using plate pattern Andritz D17C002. The consecutive refining stages were done with the Bauer 36" atmospheric refiner under the same conditions as described in Example 1. FIG. 7 shows optical and SEM images of CNF produced with mechanical pulps after one stage of pressurized refining of the black spruce chips followed by 12 consecutive stages of atmospheric refining.

Example 6

Figure 8:
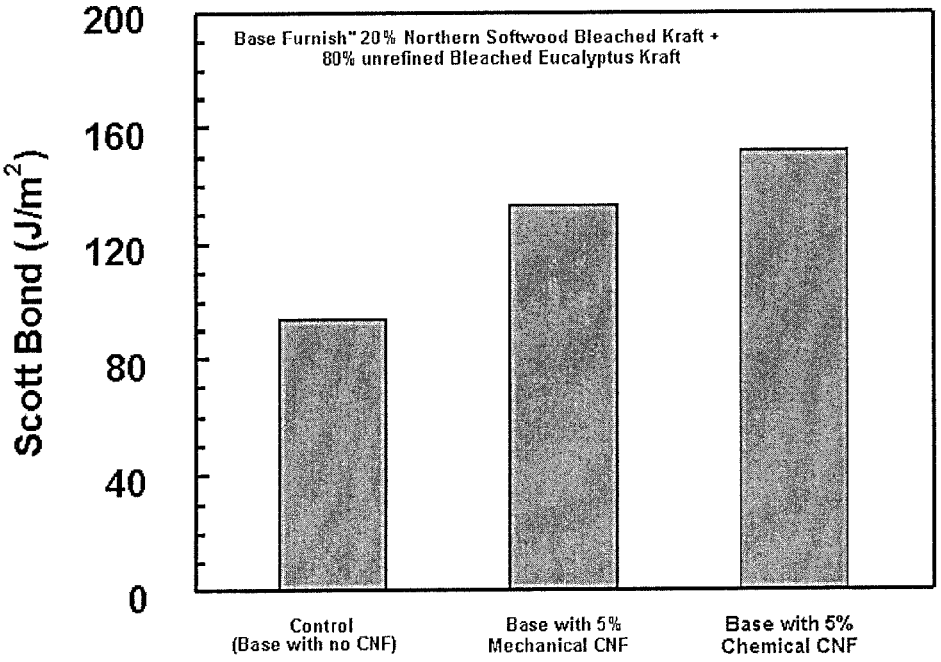
FIG. 8: Comparison of Scott bond of sheets made with and without CNF from chemical and mechanical pulps, respectively.
Figure 9:
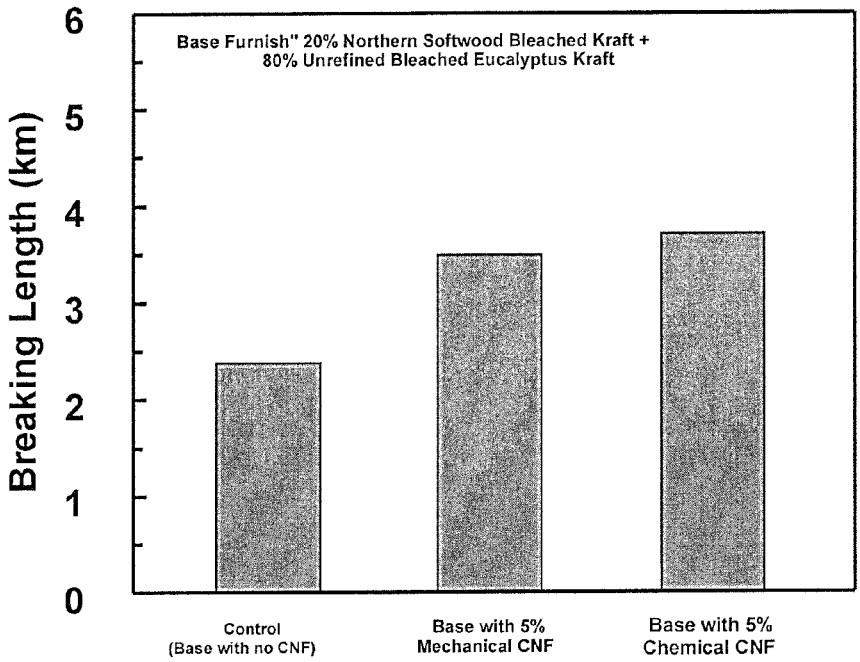
FIG. 9: Comparison of breaking length of sheets made with and without CNF from chemical and mechanical pulps, respectively.
Figure 10:
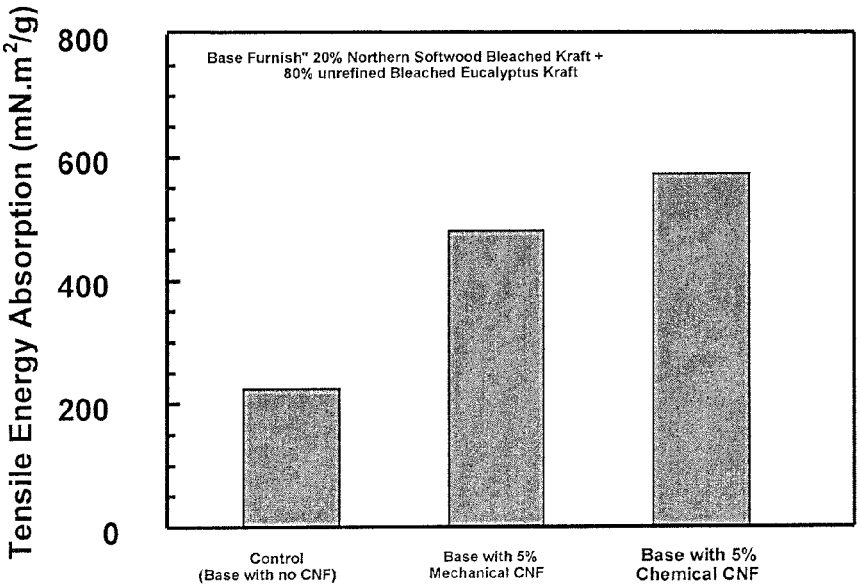
FIG. 10: Comparison of tensile energy absorption (TEA) of sheets made with and without CNF made from chemical and mechanical pulps, respectively.

The CNF produced from black spruce wood chips following the same procedure as Example 5. The CNF was disintegrated according to the PAPTAC standard (C-8P) then further disintegrated for 5 min in a laboratory standard British disintegrator (TAPPI T205 sp-02). The well-dispersed CNF was added at 5% (based on weight) to the base kraft blend which contained 20% northern bleached softwood kraft pulp, refined to 500 mL freeness, and 80% unrefined bleached eucalyptus kraft pulp. Standard laboratory handsheets were made from the final blend of the base kraft and the CNF. For comparison, we also made a similar blend with 5% CNF produced from a chemical pulp, instead of mechanical pulp. Dry strength properties were measured on all sheets. FIGS. 8, 9 and 10 clearly show that 5% CNF addition significantly increased the internal bond strength (Scott bond), breaking length, and tensile energy absorption. The CNF made with wood chips and mechanical pulp had lower reinforcing performance than those made from the chemical pulp. However, they still significantly increased the sheet strength properties when compared to the sample made without any CNF addition (control).

Example 7

Over 100 kg of cellulose nanofilaments were produced from a bleached softwood kraft pulp according to the present invention. This CNF was used in a pilot paper machine trial to validate our laboratory findings on the improvement of wet-web strength by CNF. The machine was running at 800 m/min using a typical fine paper furnish composed of 80% BHKP/20% BSKP. Papers of 75 g/m$^2$ grammage containing up to 27% PCC were produced in the absence and presence of 1 and 3% CNF dosages. During the trial, draw tests were carried out to determine the resistance of wet-web to break due to increased web tension. In this test, web tension was increased gradually by increasing speed difference between the third press nip and the 4$^{th}$ press where the web was not supported by press felt (open draw). A high draw at web breaking point reflects a strong wet-web which should lead to good paper machine runnability. The results of the draw test indicated that CNF had increased the draw substantially, from 2% to over 5%. This improvement suggest that CNF is a powerful strengthening agent for never-dried moist webs and thus could be used to reduce web breaks, especially in those paper machine equipped with long open draws. It should be pointed out that at present, there is no commercial additive that could improve the strength of never-dried wet-web, including dry strength agents and even wet strength agents used to improve the strength of re-wetted sheets.

In addition to the higher wet-web strength, CNF also improved the tensile strength of the dried paper. For example, the addition of 3% CNF allowed the production of paper with 27% PCC having tensile energy absorption (TEA) comparable to paper made with only 8% PCC made without CNF.

The above examples clearly show that CNF produced by this novel invention can substantially improve the strength of both wet-webs and dry paper sheets. Its unique powerful strengthening performance is believed to be brought by their long length and very fine width, thus a very high aspect ratio, which results in high flexibility and high surface area. CNF may provide entanglements within the paper structure and increase significantly the bonding area per unit mass of cellulose material. We believe that CNF could be very suitable for the reinforcement of many products including all paper and paperboard grades, tissue and towel products, coating formulations as well as plastic composites.

The invention claimed is:

1. A method for producing high aspect ratio cellulose nanofilaments (CNF), comprising:

refining a pulp consisting of cellulosic fibers in a disc refiner at a high total specific refining energy of at least 2,000 kWh/t under a condition of high consistency of the pulp fibres of at least 20% by weight, and recovering a filament population consisting essentially of free and bound disc-refined cellulose nanofilaments (CNF) having an aspect ratio at least 200 up to 5,000 and a width of 30 nm to 500 nm from the disc refiner.

2. The method of claim 1, wherein said high total specific refining energy is 5,000 to 20,000 kWh/t.

3. The method of claim 1, wherein said refining is carried out in a plurality of refining passes.

4. The method of claim 3, wherein said plurality is greater than 2 and less than 15 for atmospheric refining, and less than 50 for pressurized refining.

5. The method of claim 2, wherein said refining is under low intensity comprising refining in a double disc refiner at a rotational speed of less than 1200 RPM.

6. The method of claim 5, wherein said rotational speed is 900 RPM or less.

7. The method of claim 2, wherein said refining is under low refining intensity in a single disc refiner at a rotational speed of less than 1800 RPM.

8. The method of claim 7, wherein said rotational speed is 1500 RPM or less.

9. The method of claim 1, wherein said refining is open discharge refining.

10. The method of claim 1, wherein said refining is closed discharge refining.

11. A method for producing high aspect ratio cellulose nanofilaments (CNF), comprising:

feeding a wood pulp stock consisting of cellulosic fibres and water to a disc refiner, disc-refining the cellulosic fibers of said stock in the disc refiner at a high total specific refining energy of at least 2,000 to 20,000 kWh/t under a condition of high consistency of the pulp fibres of 20% to 65%, by weight, and recovering a filament population consisting of free and bound disc-refined cellulose nanofilaments (CNF) having an aspect ratio at least 200 up to 5,000 and a width of 30 nm to 500 nm from the disc refiner.

12. The method of claim 11, wherein said high total specific refining energy is 5,000 to 12,000 kWh/t, and said cellulose nanofilaments (CNF) have an aspect ratio of 400 to 1,000, and a length above 10 μm.

13. The method of claim 11, wherein said refining is carried out in said disc refiner in a plurality of refining passes.

14. The method of claim 13, wherein said plurality is greater than 2 and less than 15 for atmospheric refining, and less than 50 for pressurized refining.

15. The method of claim 12, wherein said refining is under low intensity comprising refining in a double disc refiner at a rotational speed of less than 1200 RPM.

16. The method of claim 15, wherein said rotational speed is 900 RPM or less.

17. The method of claim 12, wherein said refining is under low refining intensity in a single disc refiner at a rotational speed of less than 1800 RPM.

18. The method of claim 17, wherein said rotational speed is 1500 RPM or less.

19. The method of claim 11, wherein said refining is open discharge refining.

20. The method of claim 11, wherein said refining is closed discharge refining.

* * * * *